US007918372B2

(12) United States Patent
Palatzky et al.

(10) Patent No.: US 7,918,372 B2
(45) Date of Patent: Apr. 5, 2011

(54) APPARATUS FOR CONTROLLING THE LATERAL OFFSET OF WEBS OF MATERIAL

(75) Inventors: Roland Palatzky, Neusaess (DE); Thomas Grimm, Augsburg (DE)

(73) Assignee: Texmag GmbH Vertriebsgesellschaft, Thalwil (CH)

( * ) Notice: Subject to any disclaimer, the term of this patent is extended or adjusted under 35 U.S.C. 154(b) by 499 days.

(21) Appl. No.: 11/686,598

(22) Filed: Mar. 15, 2007

(65) Prior Publication Data

US 2008/0054041 A1 Mar. 6, 2008

(30) Foreign Application Priority Data

Mar. 21, 2006 (DE) ..... 10 2006 012 972

(51) Int. Cl.
*B23Q 15/00* (2006.01)

(52) U.S. Cl. ..... 226/19; 226/3; 226/16

(58) Field of Classification Search ..... 226/3, 16, 226/18, 19, 20, 15
See application file for complete search history.

(56) References Cited

U.S. PATENT DOCUMENTS

| | | | | |
|---|---|---|---|---|
| 2,338,143 | A | 1/1944 | Taylerson | |
| 2,662,271 | A | 12/1953 | Greenberger | |
| 2,797,091 | A | 6/1957 | Fife | |
| 3,098,595 | A | 7/1963 | Shelton | |
| 3,177,749 | A | 4/1965 | Best et al. | |
| 3,326,435 | A | 6/1967 | Shelton | |
| 3,431,425 | A | 3/1969 | Brown et al. | |
| 3,664,561 | A | 5/1972 | Feiertag | |
| 3,760,999 | A * | 9/1973 | Sandman | 226/15 |
| 4,072,611 | A | 2/1978 | Davis | |
| 4,115,001 | A | 9/1978 | Mischo et al. | |
| 4,200,211 | A | 4/1980 | Yamagishi et al. | |

(Continued)

FOREIGN PATENT DOCUMENTS

| | | |
|---|---|---|
| DE | 29 16 828 | 11/1980 |

(Continued)

OTHER PUBLICATIONS

English translation of Office Action issued on Sep. 18, 2009 in Chinese Application No. 200710089632.X.

*Primary Examiner* — William E Dondero
(74) *Attorney, Agent, or Firm* — Fish & Richardson P.C.

(57) ABSTRACT

The present disclosure relates an apparatus for controlling the lateral offset of webs of material. The apparatus can include a support structure for supporting a roll and a mechanism for lifting the web of material off the roll. The support structure can include a fixed portion and at least one movable portion. The roll is preferably journaled to first mountings, the first mountings being attached to the movable portion of the support structure, so that the roll can be moved together with the first mountings. A potential advantage of this design is that the journal bearing of the roll on a respective shaft can be configured more easily and given smaller dimensions. According to a further aspect of the disclosure, the lifting mechanism can include at least two single rollers, rotatably journaled to two lateral supports. Such single rollers are advantageously arranged along a circular-arc plane. The web of material can thus be deflected with as large a radius as possible. This can reduce undesirable back-sway of the sagging portion of the web of material as a result of the intermittent operation. The end portions of the circular-arc plane can also extend tangentially to the provided direction of travel of the web of material, thereby potentially resulting in crease-free deflection of the web of material.

66 Claims, 10 Drawing Sheets

U.S. PATENT DOCUMENTS

| | | | | | |
|---|---|---|---|---|---|
| 4,212,419 | A | | 7/1980 | Huber | |
| 4,350,276 | A | * | 9/1982 | Kreder et al. | 226/16 |
| 4,407,438 | A | * | 10/1983 | Wiechmann | 226/15 |
| 4,648,539 | A | | 3/1987 | Dingerkus | |
| 5,074,450 | A | | 12/1991 | Lindner et al. | |
| 5,098,507 | A | * | 3/1992 | Mao | 156/351 |
| 5,406,818 | A | | 4/1995 | Linsenbardt et al. | |
| 5,485,945 | A | | 1/1996 | Linsenbardt et al. | |
| 5,775,562 | A | | 7/1998 | Jungk et al. | |
| 5,829,298 | A | | 11/1998 | Linsenbardt et al. | |
| 5,947,617 | A | | 9/1999 | Kondo | |
| 6,076,718 | A | | 6/2000 | Matsuda et al. | |
| 6,450,381 | B1 | | 9/2002 | Ernst et al. | |
| 6,554,223 | B1 | | 4/2003 | Kistner et al. | |

FOREIGN PATENT DOCUMENTS

| | | |
|---|---|---|
| DE | 31 23 584 | 12/1982 |
| DE | 35 35 011 | 1/1987 |
| DE | 43 14 672 | 11/1994 |
| GB | 826 251 | 12/1959 |
| JP | 59108657 | 6/1984 |
| JP | 7097111 | 4/1995 |

* cited by examiner

APPARATUS FOR CONTROLLING THE LATERAL OFFSET OF WEBS OF MATERIAL

CROSS-REFERENCE TO RELATED APPLICATION

Under 35 U.S.C. §119, this application claims the benefit of German patent application serial number 10 2006 012 972.5, filed Mar. 21, 2006, the contents of which are hereby incorporated by reference.

FIELD

The present disclosure relates to an apparatus for controlling the lateral offset of webs of material. The apparatus can include a support structure for supporting a roll and a mechanism for lifting the web of material off the roll. The present disclosure also relates to a system and a method for advancing one or more webs of material, each including such an apparatus for controlling the lateral offset of webs of material.

BACKGROUND

Known from the prior art is an apparatus for controlling the lateral offset of webs of material, including, as illustrated in FIGS. 1*a* and 1*b*, a roll for guiding a web of material, the roll being rotatably and laterally shiftably mounted via ball bearings on a continuous shaft connected to a fixed support. The lateral position of the web of material is measured via a detector. When the position of the web of material needs to be corrected, the roll can be shifted laterally on the fixed shaft via a servomotor during the advancement of the web. Provided for this purpose is a control unit that processes the signals from the detector and drives the actuator accordingly. Since the travel distance is limited, before the maximum travel distance is reached a lifting mechanism has to raise the web so the roll can be moved back into a neutral position without contacting the web. In the prior art, the lifting mechanism consists of a single roller that can be shifted pneumatically. For the above-stated reason, the apparatus is normally used according to the prior art in intermittent mode, including the following phases of operation: advancement of the web of material with simultaneous control of the lateral offset of the web, and halting of the web of material with lifting by the lifting mechanism and return of the roll to neutral position.

SUMMARY

The present disclosure provides for refining an apparatus for controlling the lateral offset of webs of material such that the apparatus exhibits improved dynamics, particularly in intermittent mode.

The apparatus to control the lateral offset of webs of material includes according to the present disclosure a support structure for supporting a roll and a mechanism for lifting the web of material off the roll. According to the disclosure, the support structure includes a fixed portion and at least one movable portion.

Such an apparatus according to the disclosure is employed in a system for advancing one or more webs of material or for advancing pieces of material, the system also including at least one conveyor belt. The conveyor belt can be disposed before the apparatus for controlling the lateral offset, taken in the direction of travel of the material, and an additional conveyor belt can be disposed after the device for controlling the lateral offset, taken in the direction of travel of the material. An arrangement for receiving a roll of web material can also be provided, the arrangement being equipped with a drive unit for unwinding the roll of web material. To cut the web of material into pieces of material, a cutting apparatus is provided after the apparatus for controlling the lateral offset, taken in the direction of travel of the material.

A control unit is incorporated to control the lateral offset of the web of material by shifting a moving portion of the support structure. This control unit processes the signals from a unit for detecting the position of the web of material and thus makes it possible to shift the first movable portion of the support structure and/or (if present) the second movable portion of the support structure via one or more actuators.

The lifting mechanism is mounted such that it is able to swivel and/or move in translation and can be shifted between a first position and a second position. In the first position, the lifting mechanism is not in contact with the web of material. In the second position, the lifting mechanism in operation lifts the web of material off the roll. The inventive apparatus for controlling the lateral offset of webs of material can thus be operated intermittently with the following steps, the steps being controlled by a control unit:

- controlling the lateral offset of the web of material by laterally shifting the roll during the advancement of the web of material, the lifting mechanism being in the first position,
- braking the web of material,
- lifting the web of material off the roll by shifting the lifting mechanism into its second position,
- returning the roll to a neutral position.

According to the disclosure, the support structure includes a fixed portion and at least one movable portion. The roll is preferably journaled to first mountings that are attached to a first movable portion of the support structure, such that the roll can be moved together with the first mountings. The advantage of this design is that the journal bearing of the roll on a respective shaft can be configured more easily and given smaller dimensions. In contrast to the prior art, according to which the roll is slidably disposed on a fixed shaft, the shaft according to the present disclosure has smaller forces and torques to absorb. This is because the distance between the region of force absorption on the shaft and the first mountings can be kept relatively small by design, since no play is necessary for laterally shifting the roll on the shaft. Instead, lateral shifting of the roll is effected by laterally shifting the movable portion of the support structure, the shaft also being shifted laterally at the same time. In this variant, the roll controls the lateral offset of the web of material during the advancement of the web, whereas the lifting unit supports the web of material during stops.

The journal bearing of the roll on the shaft, which is preferably configured as two ball bearings, can thus have a smaller diameter. This measure further achieves the effect that the moment of inertia of the roll plus the ball bearings is lower, resulting in improved dynamic behavior.

A further variant of the above-described design is that the lifting mechanism is journaled to two mountings that are attached to a second movable portion of the support structure, such that not only can the roll be moved together with the first mountings, but the lifting mechanism can also be moved together with the mountings of the lifting mechanism. The first movable portion can be moved together with or independently of the roll, and the second movable portion together with or independently of the lifting mechanism. The advantage of this measure is that the lifting mechanism can still be extended while the web of material is moving, since it can be shifted laterally together with the roll. This is useful because it is also necessary to control lateral offset when the web of material is being braked.

In a third variant, the roll is journaled to first mountings that are attached to the fixed portion of the support structure, and the lifting mechanism is journaled to second mountings that are attached to the first movable portion of the support structure, such that the lifting mechanism can be moved together with the mountings of the lifting mechanism. In this variant, the lifting mechanism controls the lateral offset of the web of material during the advancement of the web. The roll has no contact with the web of material during advancement, but instead supports the web of material only during stops. According to this variant, the inventive apparatus for controlling the lateral offset of webs of material can be operated intermittently with the following steps, the steps being controlled by a control unit:

controlling the lateral offset of the web of material by laterally shifting the lifting mechanism during the advancement of the web of material, braking the web of material, lowering the lifting mechanism so the web of material comes into contact with the roll, and returning the lifting mechanism to a neutral position.

The first movable portion of the support structure is preferably mounted on a rail system, to be able to displace the first movable part in relation to the fixed portion of the support structure, parallel to the axis of the roll.

According to a further aspect of the disclosure, the roll has a diameter that is greater than ¼ the length of the roll, particularly greater than ⅓ of the length of the roll. This measure gives a lower angular velocity for the roll compared to the prior art, assuming equal web speeds. The inertial effects of the roll are therefore smaller as well, since the angular velocity is squared in the kinetic energy equation, whereas the moment of inertia is only simple. In addition, with a larger roll diameter it is possible to reduce the wall thickness of the roll body. The "roll body" is understood here to be the cylindrical portion of the roll.

The roll body preferably includes a composite material, particularly a fiber composite, such that the roll body has a low mass and the inertia of the entire roll is thereby reduced. To further reduce the mass of the roll body, the roll body can also be provided with one or more cavities and/or a cylindrical honeycomb structure.

According to a further aspect of the disclosure, the lifting mechanism includes at least two single rollers, rotatably journaled to two lateral supports. The single rollers are preferably disposed along a circular-arc plane or along an arcuate plane. The circular-arc plane or arcuate plane has a radius of curvature that is greater than ½ the radius of the roll, particularly greater than ⅘ the radius of the roll, so that the web of material rests crease-free on the lifting unit when the lifting unit is in the second position. In other words, the web of material is to be deflected with as large a radius as possible. This reduces any undesirable back-sway of the sagging portion of the web of material as a result of the intermittent operation. The end portions of the circular-arc plane or arcuate plane should also extend tangentially to the provided direction of travel of the web of material to bring about crease-free deflection of the web of material, particularly crease-free deflection by 90°. It is also advantageous to mount the support of the lifting mechanism off-center from the axis of the roll, also to permit crease-free deflection of the web of material.

According to a further aspect of the disclosure, a braking and/or clamping mechanism is provided to fix the web of material after or during the braking of the web of material, such that the inertia of the web of material is braked when the web of material is halted. The braking and/or clamping mechanism preferably includes a lower portion and an upper portion.

The braking and/or clamping mechanism can be designed such that on actuation, a force is exerted in the direction of the roll. In this way, when the web of material is halted and the braking and/or clamping mechanism actuated, not only is the inertia of the web of material braked, but the roll is braked as well.

Alternatively, the braking and/or clamping mechanism can be adapted such that on actuation, a force is exerted in the direction of the fixed portion of the support structure. In this case, the bottom portion can be attached to the fixed portion of the support structure or can be formed directly by the fixed portion of the support structure.

The braking and/or clamping mechanism can further alternatively include two crossbars, the braking and/or clamping mechanism being designed to press, on actuation, the two crossbars against the web of material. In addition, the braking and/or clamping mechanism can include two brake rollers, with the web traveling between them. The brake rollers can include a brake mechanism for braking or clamping the web of material. Optionally, at least one axis of the brake rollers can be provided to be shiftable.

The present disclosure also provides for refining the apparatus for controlling the lateral offset of webs of material in such fashion that the apparatus permits improved pick-up of the web of material.

The apparatus for controlling the lateral offset of webs of material includes, according to the present disclosure, a guide mechanism for guiding the web of material during the advancement of the web of material and a lifting mechanism for lifting the web of material off the guide mechanism. According to the disclosure, the guide mechanism includes at least two interconnected guide units, each including at least one roller. In a preferred embodiment of the present disclosure, the lifting mechanism also includes at least two lifting units.

The guide mechanism is movably mounted on a support or a movable portion of a support structure, so that the guide mechanism can be displaced relative to the support or support structure along the axial direction of the rollers of the guide units. The guide mechanism in this case is preferably movably mounted on the support or the movable portion of the support structure via a rail system.

In a further preferred embodiment, the lifting units are arranged in succession or alternation with the guide units.

The rollers of the guide units are preferably arranged in succession with one another such that the plane spanned by the axes of the rollers represents a circular-arc plane or an arcuate plane. In this case, the radius of curvature of the circular-arc plane or arcuate plane must be as large as possible, to thereby reduce any undesirable back-sway of the sagging portion of the web of material as a result of the intermittent operation. The radius of curvature of the circular-arc plane or the arcuate plane is usually already relatively large for design reasons, owing to the alternating arrangement of the guide units and lifting units. The end portions of the circular-arc plane or arcuate plane should also extend tangentially to the provided direction of travel of the web of material to bring about crease-free deflection of the web of material, particularly crease-free deflection by 90°.

The lifting units should be arranged in succession or alternation with the guide units in such fashion as to constitute the same circular-arc plane or arcuate plane as the plane spanned by the axes of the rollers of the guide units. This is also usually the case for design reasons, due to the alternating arrangement of the guide units and lifting units.

According to a further aspect of the disclosure, the lifting units each include one or more elongate bodies having a straight or curved surface.

The lifting mechanism can be shifted between a first position and a second position. In the first position, the lifting mechanism in operation is not in contact with the web of material. In the second position, the lifting mechanism in operation lifts the web of material off the guide mechanism. To shift the lifting mechanism between the first position and the second position, one or more actuators are provided.

A first variant is to arrange the lifting units in succession or alternation with the guide units in the provided direction of travel of the material. The elongate bodies of the lifting units are preferably moved between the first position and the second position in a restrictive guide, particularly a sliding block guide. For this purpose, the lifting units are connected to one another by two first mountings, which are pivotably mounted such that the lifting units are retracted in the first position. "Retracted" here means that their surfaces, viewed radially, are located below imaginary points created by the support points of the web of material on the rollers during the advancement of the web of material. The lifting units thus are not in contact with the web of material. In the second position, the lifting units are "extended," i.e. their surfaces, viewed radially, are located above the imaginary points, and they lift the web of material off the guide mechanism. The lifting units are preferably slightly curved, so that they lift the web of material with exactly the same radius of curvature as that of the guide mechanism. This keeps the web of material from creasing when it is lifted by the lifting mechanism.

In a second variant, the lifting units are arranged in succession or alternation with the guide units perpendicularly to the provided direction of travel of the material. A guide unit in this case includes one or more single rollers, which are arranged in succession with one another such that their axles extend parallel to one another and they are connected to one another by two second mountings, one on each side of each roller. The elongate body of a lifting unit is preferably bent along its longitudinal direction such that it has exactly or approximately the same radius of curvature as the circular-arc plane or arcuate plane spanned by the axes of the rollers of the guide units. This makes it possible for the web of material to be picked up by the lifting mechanism with exactly the same radius of curvature as that of the guide mechanism. This keeps the web of material from creasing when it is lifted by the lifting mechanism. The lifting mechanism is secured by two lateral mountings such that it is movable in translation between the first position and the second position.

According to a further aspect of the disclosure, a braking and/or clamping mechanism is provided to fix the web of material after or during the braking of the web of material, such that the inertia of the web of material is braked when the web is halted. The braking and/or clamping mechanism preferably includes an upper and a lower portion.

The braking and/or clamping mechanism can be designed such that on actuation, a force is exerted in the direction of the lifting mechanism. In this case, the braking and/or clamping mechanism preferably has a lower portion formed directly by the lifting mechanism and an upper portion including an arcuate counterplate that can be pressed in the direction of the lifting mechanism and fits exactly together with the lifting mechanism. When the web of material is halted, the counterplate can first be pressed with little force against the web of material to brake it, in order then to fix the web of material with greater force. Very fast braking of the web of material can be obtained with this design.

BRIEF DESCRIPTION OF THE FIGURES

The present disclosure is explained below on the basis of preferred embodiments with reference to the appended drawings.

DETAILED DESCRIPTION

Figure 1A:
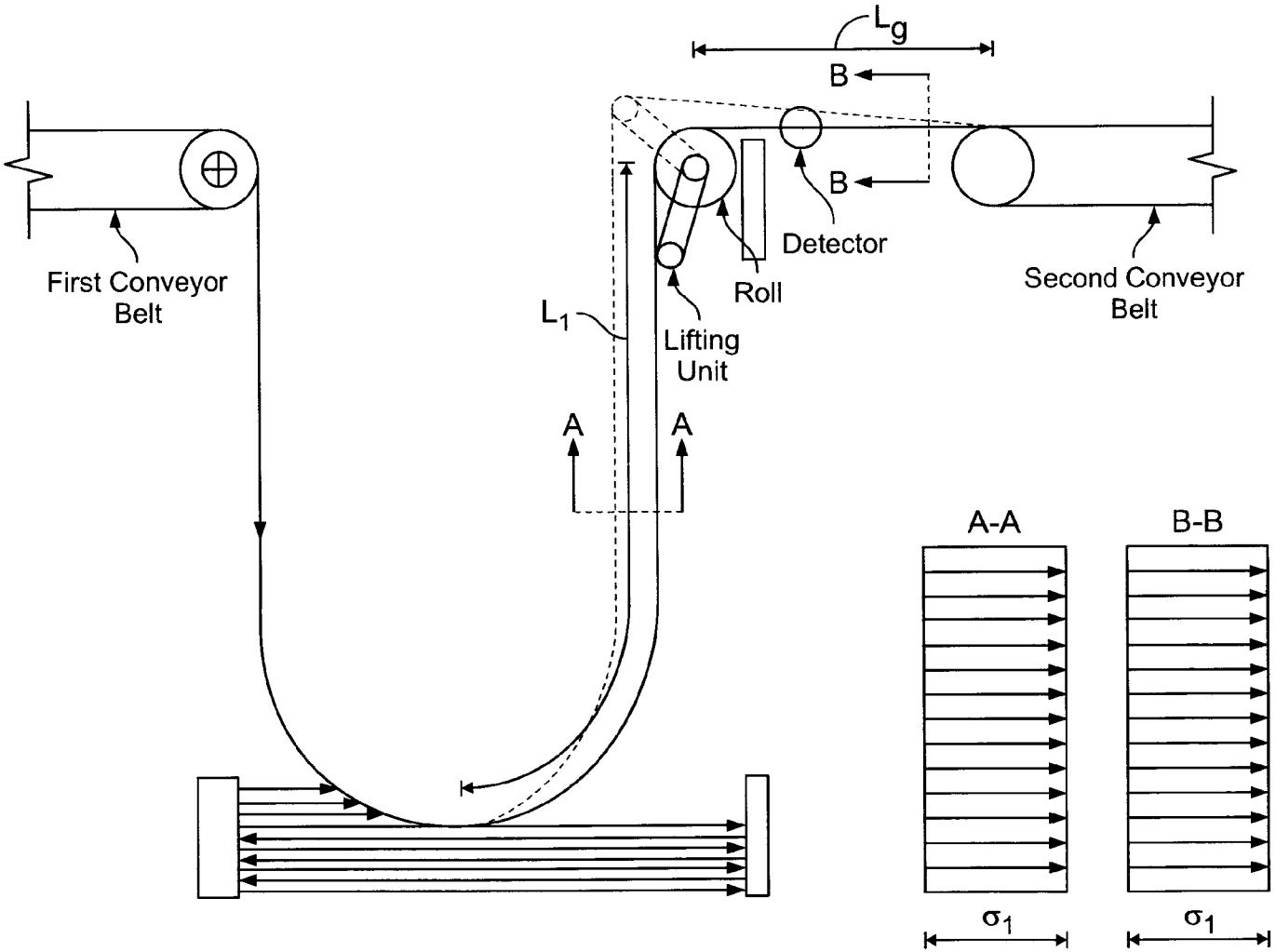
FIG. 1A PRIOR ART
FIGS. 1*a* and 1*b* show a system for advancing webs of material according to the prior art, with FIG. 1*a* depicting the cross section and FIG. 1*b* the plan view from above.
Figure 1B:
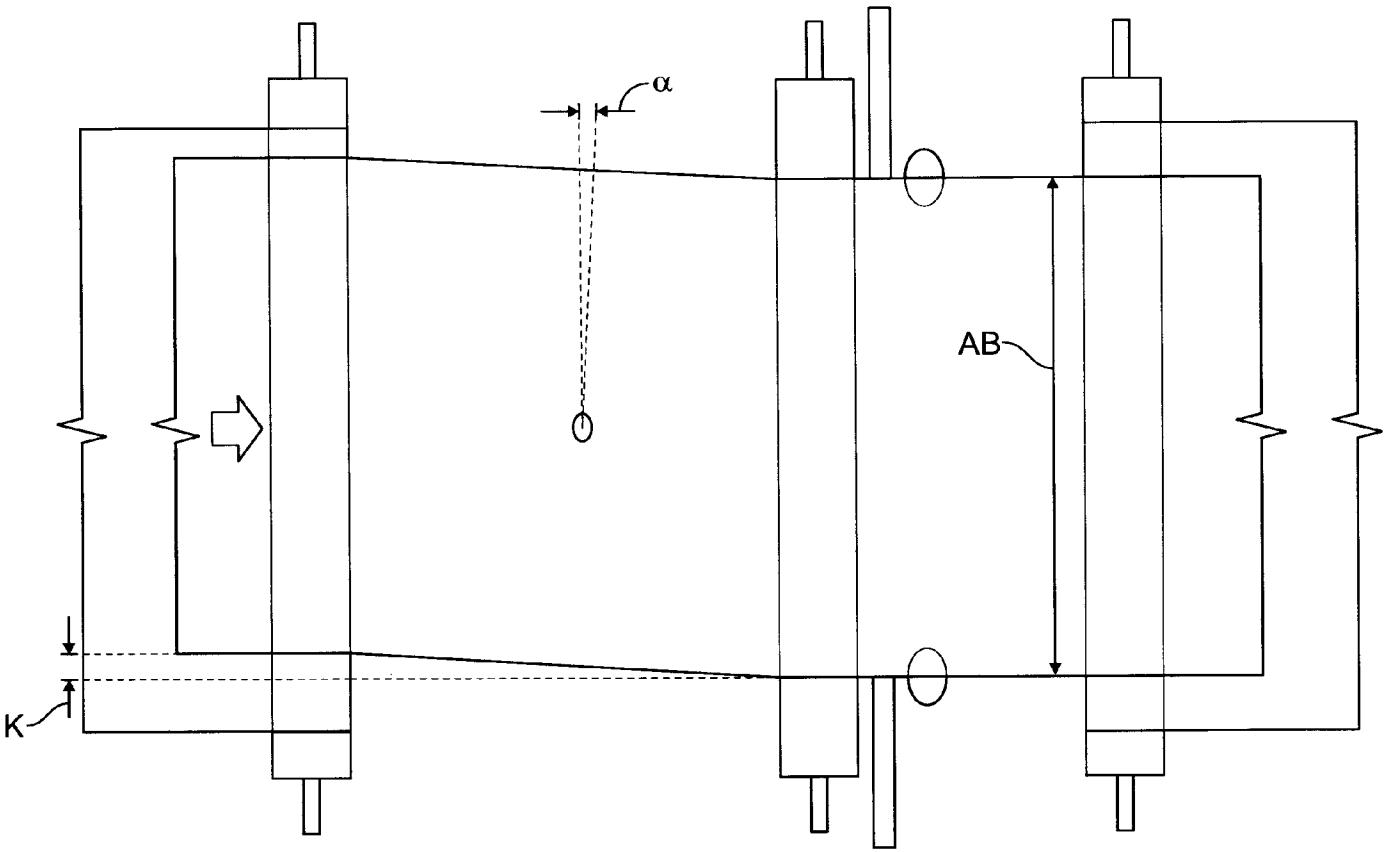
FIG. 1B PRIOR ART

FIGS. 1*a* and 1*b* show a system for advancing webs of material according to the prior art, FIG. 1*a* depicting a cross section and FIG. 1*b* a plan view from above. The system includes a first conveyor belt that advances the web of material, and a roll that again picks up the hanging loop of web. This is followed by additional advancement of the web of material by a second conveyor belt. The diameters of the roll and of the two conveyor belts are dimensioned to be approximately the same in this case. The apparatus is normally used according to the prior art in intermittent mode, including the following phases of operation: advancement of the web of material with simultaneous control of the lateral offset of the web, and halting of the web of material with lifting by the lifting mechanism and return of the roll to neutral position. To lift the web of material off the roll when the web of material is stopped in intermittent operation, the lifting mechanism according to the prior art consists of a single roller that can be shifted pneumatically. The roll is rotatably and laterally shiftably mounted via ball bearings on a continuous shaft connected to a fixed support, to control the lateral offset of the web of material. The lateral position of the web of material is measured by a detector and processed by a control unit, which changes, if necessary, the lateral position of the roll on the shaft via an actuator.

Figure 2:
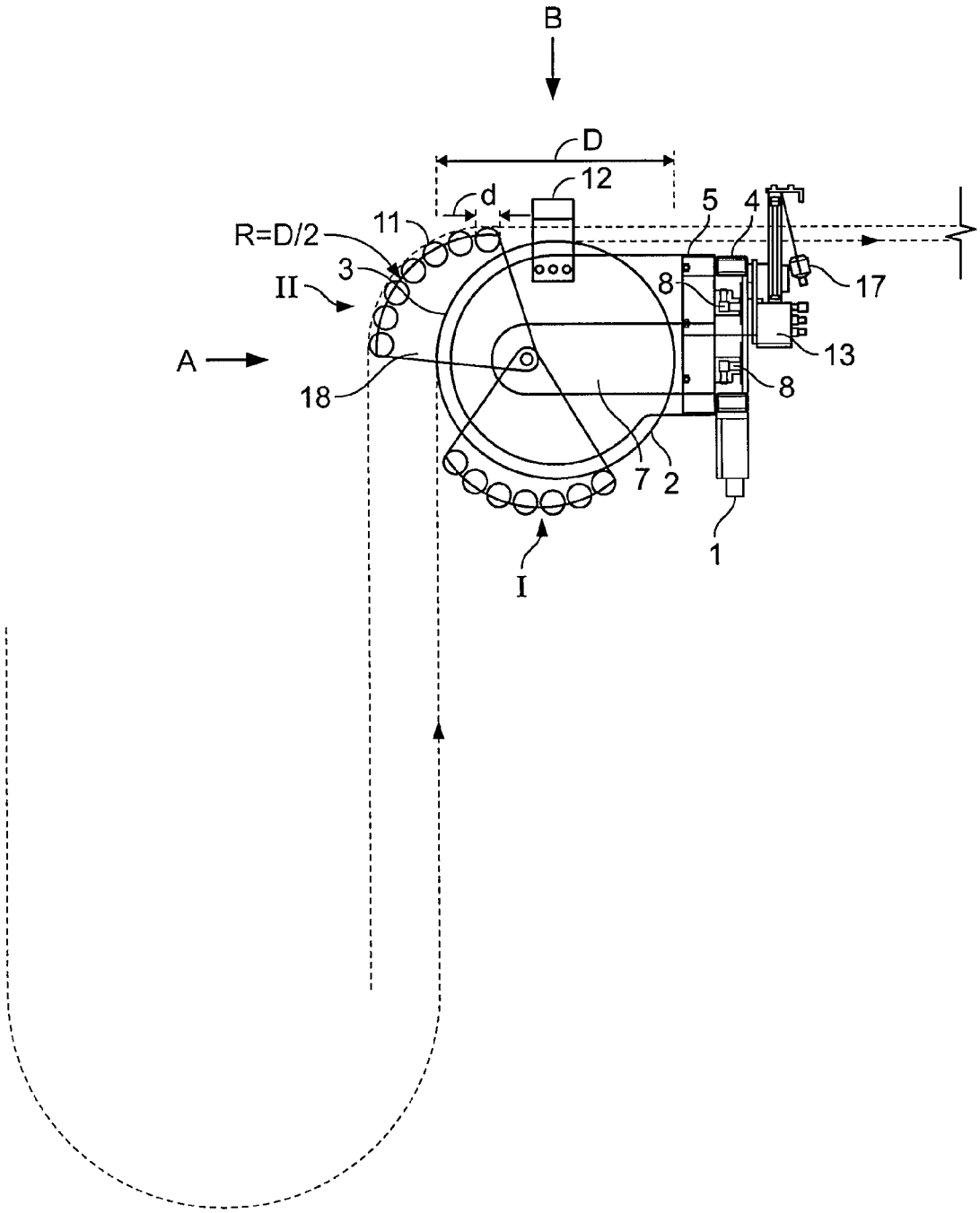
FIG. 2 shows a cross section of an apparatus for controlling the lateral offset of webs of material according to a first exemplary embodiment of the present disclosure.

FIG. 2 shows a cross section of an apparatus for controlling the lateral offset of webs of material according to a first embodiment of the present disclosure. The apparatus includes according to the present disclosure a support structure 1 for supporting a roll 2 and a mechanism 3 for lifting the web of material off the roll 2. According to the disclosure, the support structure 1 includes a fixed portion 4 and at least one movable portion 5.

Figure 7:
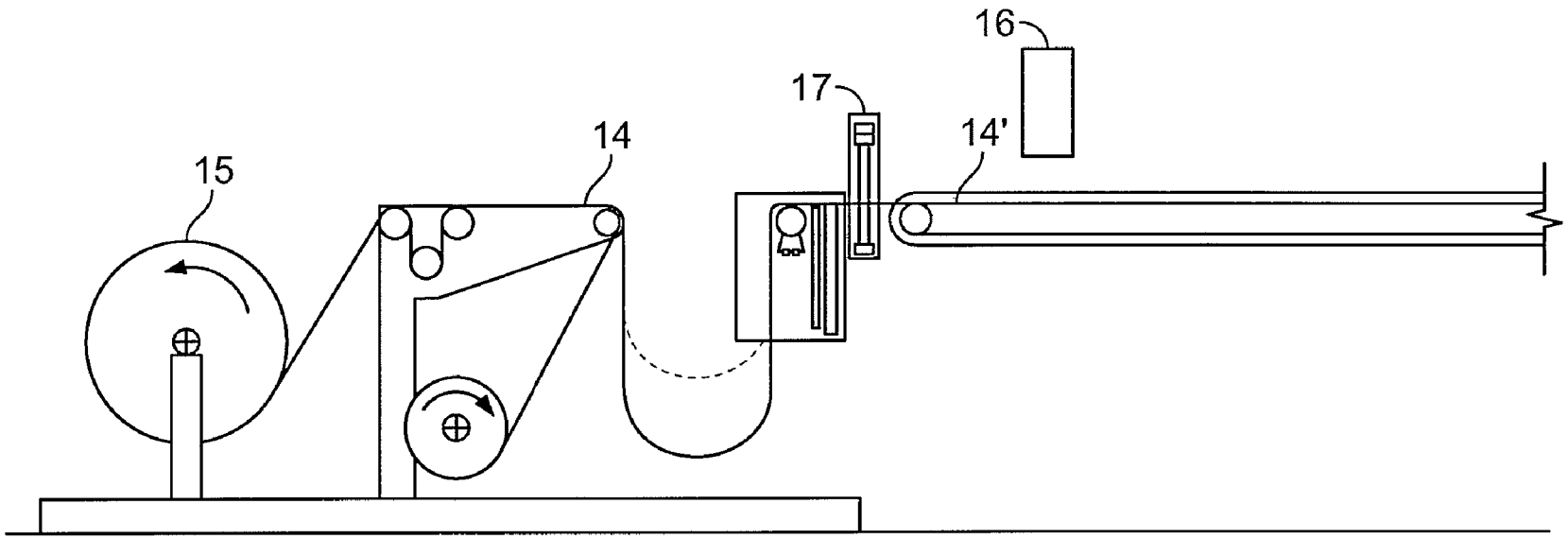
FIG. 7 shows a system for advancing and cutting one or more webs of material, including an apparatus for controlling the lateral offset of webs of material according to an embodiment of the present disclosure.

Such an apparatus according to the disclosure is used in a system for advancing one or more webs of material or for advancing pieces of material, as illustrated in FIG. 7. In this embodiment, the system includes two conveyor belts 14, 14'. Conveyor belt 14 is arranged before the apparatus for controlling the lateral offset, taken in the direction of travel of the material, and conveyor belt 14' is arranged after the apparatus for controlling the lateral offset, taken in the direction of travel of the material. Also provided is an arrangement for receiving a roll 15 of web material, the arrangement being equipped with a drive unit for unwinding the roll of web material. To cut the web of material into pieces of material, a cutting apparatus 16 is provided after the apparatus for controlling the lateral offset, taken in the direction of travel of the material.

In the embodiment illustrated in FIG. 2, a control unit is incorporated to control the lateral offset of the web of material by shifting a movable portion 5 of the support structure 1. This control unit processes the signals from a unit 17 for detecting the position of the web of material and thus makes it possible for the movable portion 5 of the support structure 1 to be shifted via an actuator 13.

The lifting mechanism 3 is pivotably movably mounted and can be shifted between a first position I and a second position II. In the first position I, the lifting mechanism 3 is not in contact with the web of material. In the second position II, in operation the lifting mechanism 3 lifts the web of material off the roll 2. The inventive apparatus for controlling the lateral offset of webs of material can in this case be operated intermittently with the following steps, the steps being controlled by the control unit:

- controlling the lateral offset of the web of material by laterally shifting the roll 2 during the advancement of the web of material, the lifting mechanism 3 being in the first position I,
- braking the web of material,
- lifting the web of material off the roll 2 by shifting the lifting mechanism 3 into its second position II, and
- returning the roll 2 to a neutral position.

Figure 4:
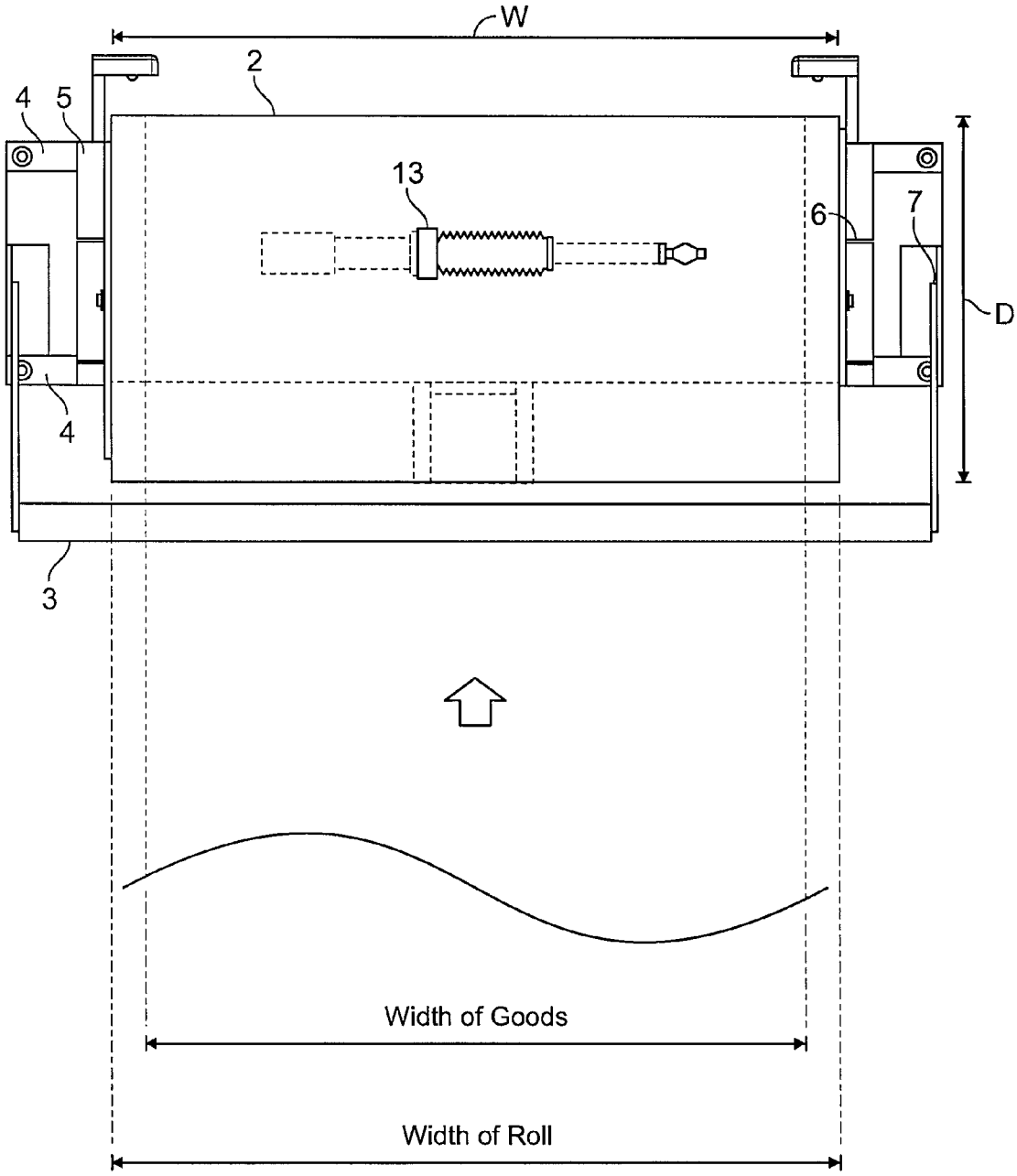
FIG. 4 shows a plan view, in the direction of Arrow A according to FIG. 2, of an apparatus for controlling the lateral offset of webs of material according to the first embodiment of the present disclosure.
Figure 5:
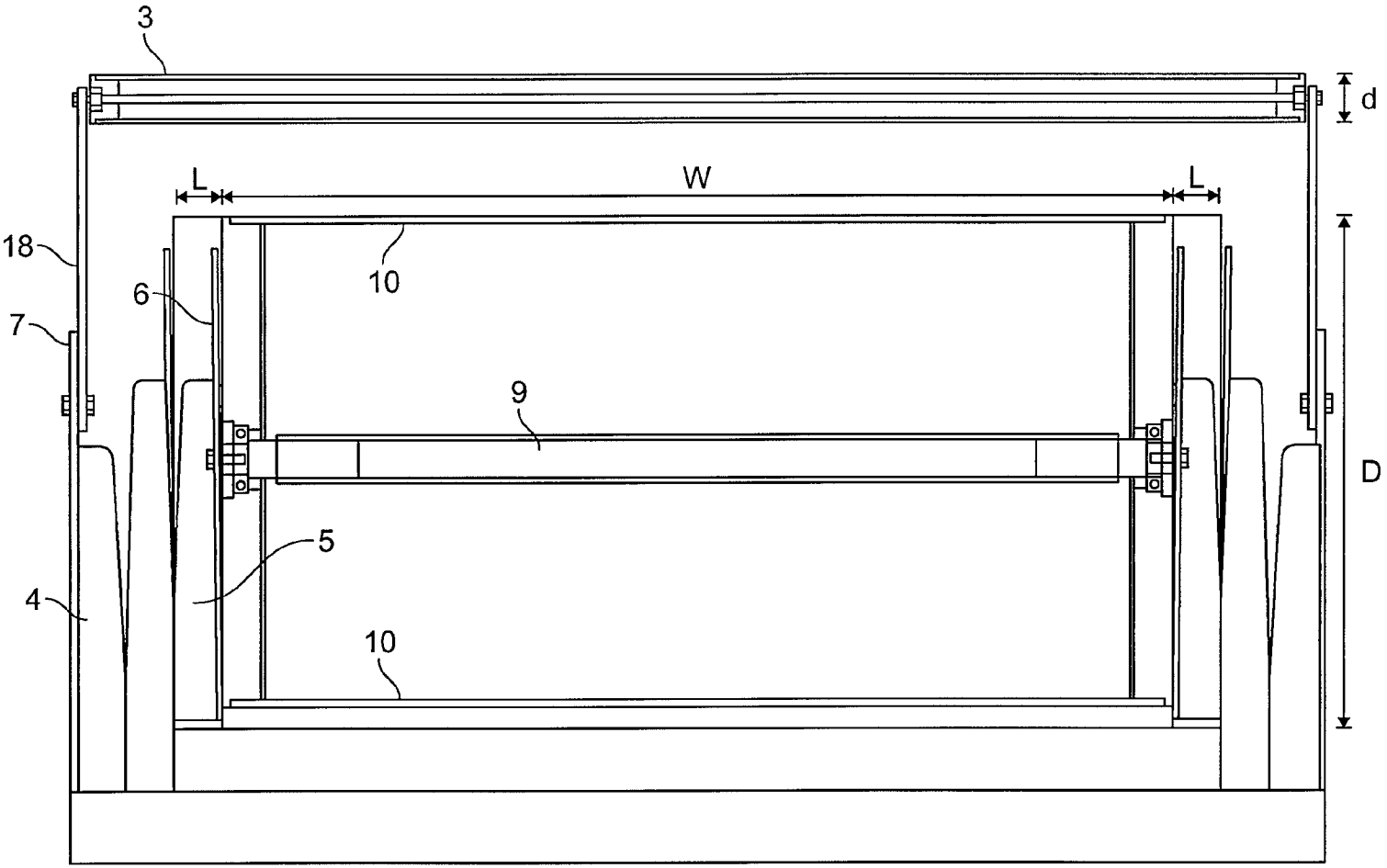
FIG. 5 shows a horizontal cross section, in the direction of Arrow B according to FIG. 2, of an apparatus for controlling the lateral offset of webs of material according to the first embodiment of the present disclosure.

According to the first embodiment of the present disclosure, the support structure 1 includes a fixed portion 4 and a movable portion 5. FIG. 4 provides a plan view, in the direction of Arrow A according to FIG. 2, of an apparatus for controlling the lateral offset of webs of material according to this embodiment. FIG. 5 correspondingly shows a horizontal section of an apparatus for controlling the lateral offset of webs of material according to this embodiment, viewed in the direction of Arrow B depicted in FIG. 2. In this embodiment of the disclosure, the roll 2 is preferably journaled to first mountings 6 (see FIG. 4), which are attached to a first movable portion 5 of the support structure 1, such that the roll 2 can be moved together with the first mountings 6 by a maximum travel distance L (see FIG. 5). The lifting unit 3 is attached to second mountings 7, which are attached to the fixed portion 4 of the support structure 1. The advantage of this design is that the journal bearing of the roll 2 on a respective shaft 9, which is connected to the first mountings 6, can be configured more easily and given smaller dimensions. In contrast to the prior art, according to which the roll is slidably disposed on a fixed shaft, the shaft 9 according to the present disclosure has lower forces or torques to absorb. This is because the distance between the region of force absorption on the shaft 9 and the first mountings 6 can be kept relatively small by design, since no play is necessary for laterally shifting the roll 2 on the shaft 9. Instead, lateral shifting of the roll 2 is effected by laterally shifting the movable portion 5 of the support structure 1, the shaft 9 also being shifted laterally at the same time. In this variant, the roll 2 controls the lateral offset of the web of material during the advancement of the web of material, whereas the lifting unit 3 supports the web of material during stops.

The mounting of the roll 2 on the shaft 9, which according to FIG. 5 is preferably configured as two ball bearings, has a smaller diameter in this case. This measure further achieves the effect that the moment of inertia of the roll 2 plus the ball bearings is lower, resulting in improved dynamic behavior.

Figure 6:
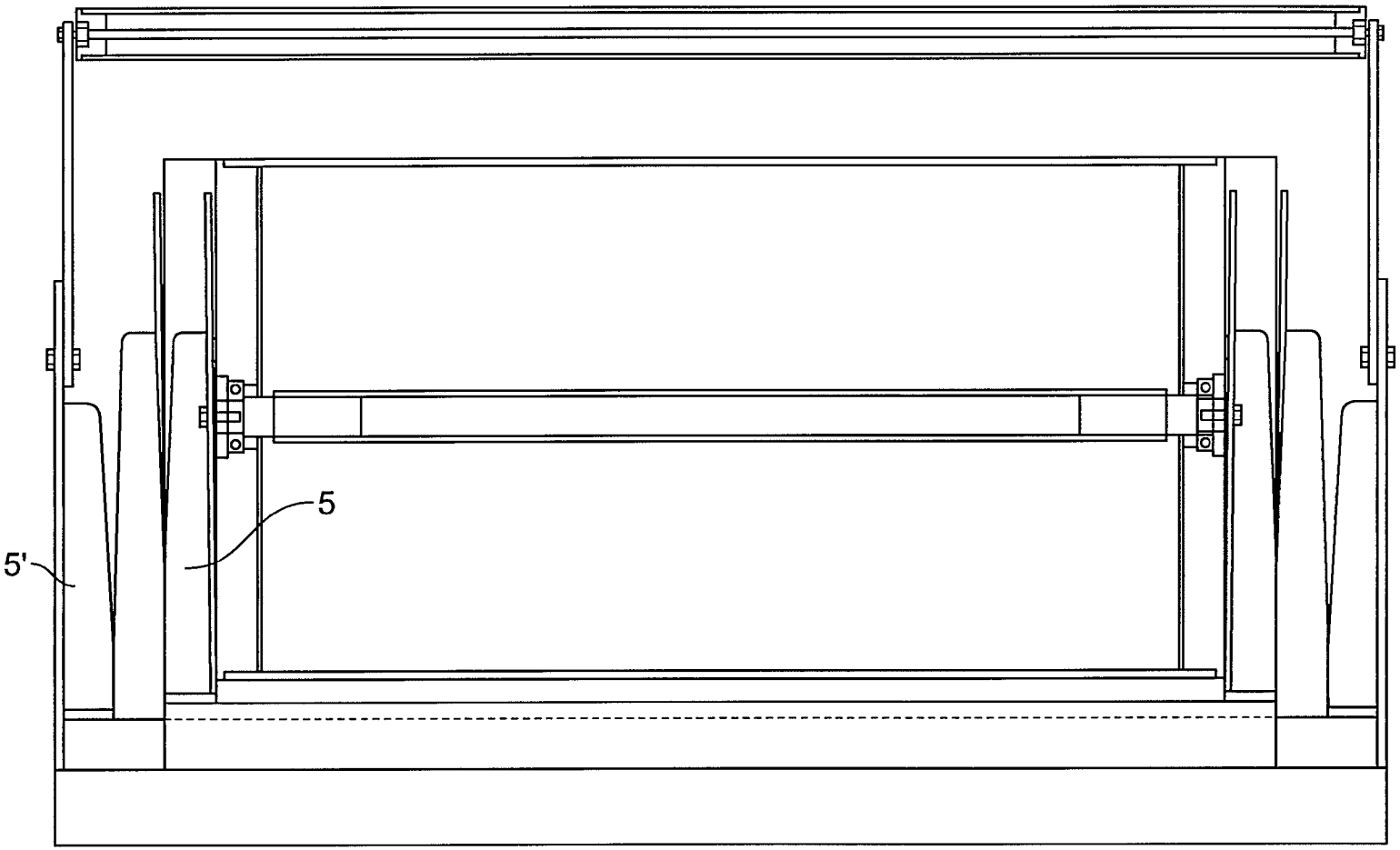
FIG. 6 shows a horizontal cross section, in the direction of Arrow B according to FIG. 2, of an apparatus for controlling the lateral offset of webs of material according to a second embodiment of the present disclosure.

FIG. 6 shows a second embodiment of the present disclosure. The roll 2 is journaled to first mountings 6, which are attached to the first movable portion 5 of the support structure 1, and the lifting mechanism 3 is journaled to second mountings 7 that are attached to a second movable portion 5' of the support structure, such that not only can the roll 2 be moved together with the first mountings 6, but the lifting mechanism 3 can also be moved together with the mountings 7 of the lifting mechanism. The first movable portion 5 of the support structure 1 can be moved together with or independently of the roll 2, and the second movable portion 5' of the support structure 1 together with or independently of the lifting mechanism 3. The advantage of this measure is that the lifting mechanism 3 can still be extended while the web of material is in motion, since it can be shifted laterally together with the roll 2. This is useful because it is also necessary to control lateral offset when the web of material is being braked.

In a third embodiment of the present disclosure, the roll 2 is journaled to first mountings 6 attached to the fixed portion 4 of support structure 1, and the lifting mechanism 3 is journaled to second mountings 7 attached to the first movable portion 5 of support structure 1, such that the lifting mechanism 3 can be moved together with the mountings 7 of the lifting mechanism. In this embodiment, the lifting mechanism 3 controls the lateral offset of the web of material during the advancement of the web of material. The roll 2 has no contact with the web of material during advancement, but instead supports the web of material only during stops. In this embodiment, the inventive apparatus for controlling the lateral offset of webs of material can be operated intermittently with the following steps, the steps being controlled by a control unit:

- controlling the lateral offset of the web of material by laterally shifting the lifting mechanism 3 during the advancement of the web of material,
- braking the web of material,
- lowering the lifting mechanism 3 so that the web of material comes into contact with the roll 2, and
- returning the lifting mechanism 3 to a neutral position.

Figure 3:
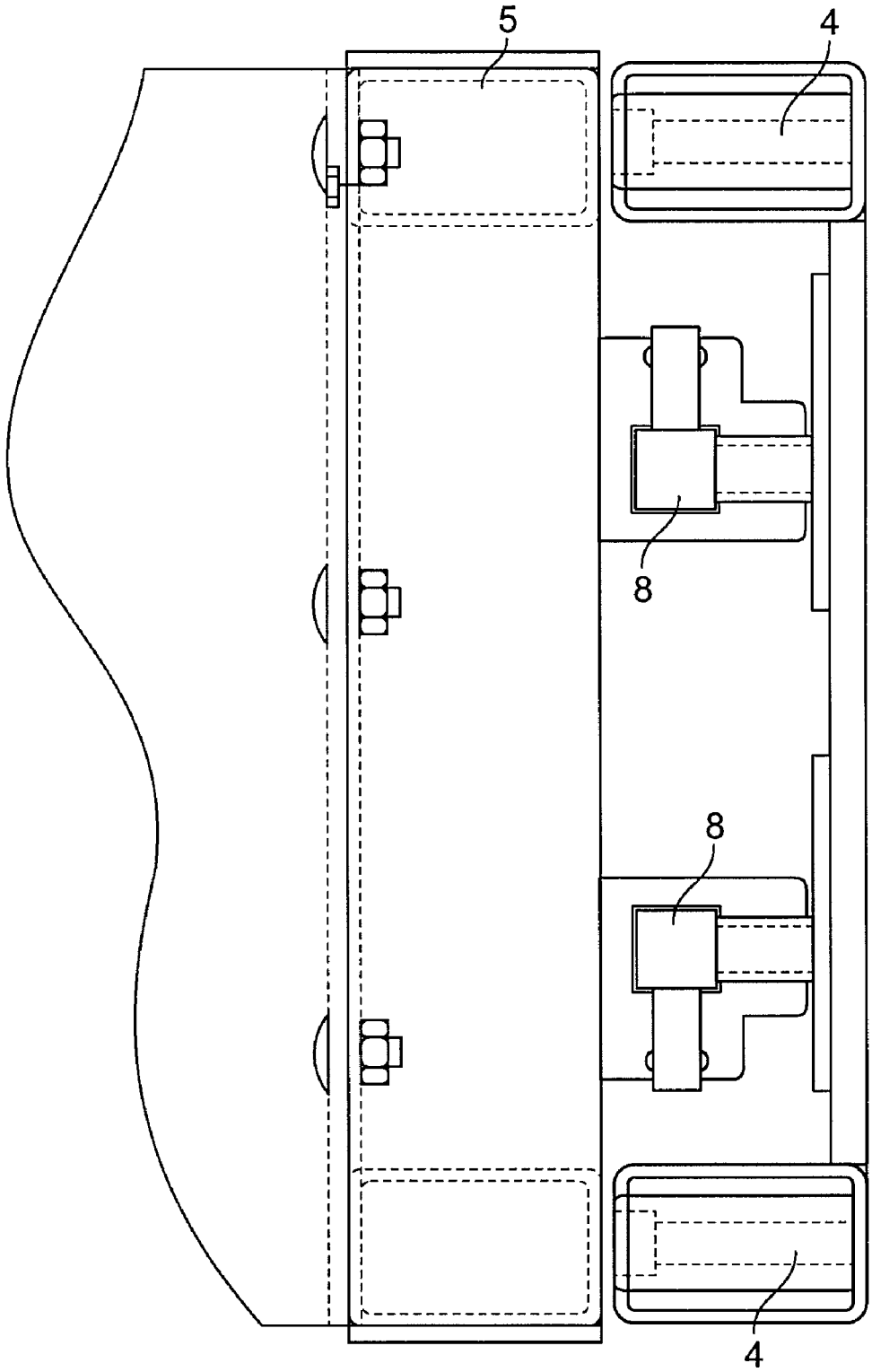
FIG. 3 shows a cross section of the support structure including a fixed and a movable portion, according to the first embodiment of the present disclosure.

FIG. 3 shows a cross section of the support structure 1 according to FIG. 2, FIG. 4 and FIG. 5, in which the first movable portion 5 of the support structure 1 is mounted on a rail system 8, to be able to displace the first movable portion 5 relative to the fixed portion 4 of the support structure 1, parallel to the axis of the roll. The rail system 8 consists in this embodiment of two traveling rails connected to the fixed portion 4 of the support structure 1, and traveling rollers supported thereon and connected to the movable portion 5 of the support structure 1.

The roll 2 depicted in FIG. 4 has a diameter D that is equal to approximately ½ the length W of the roll 2. However, according to the disclosure a roll 2 can also be provided whose diameter D is greater than ¼ the length W of the roll 2, particularly greater than ⅓ the length W of the roll 2. This measure gives a lower angular velocity for the roll 2 compared to the prior art, assuming equal web speeds. The inertial effects of the roll 2 are therefore smaller as well, since the angular velocity is squared in the kinetic energy equation, whereas the moment of inertia is only simple. In addition, with a larger roll diameter D it is possible to reduce the wall thickness of the roll body 10. The "roll body" 10 is understood here to be the cylindrical portion of the roll.

The roll body 10 preferably includes a composite material, particularly a fiber composite, such that the roll body 10 has a low mass and the inertia of the entire roll 2 is thereby reduced. To further reduce the mass of the roll body 10, the roll body 10 can also be provided with one or more cavities and/or a cylindrical honeycomb structure.

According to FIG. 2, the lifting mechanism 3 includes at least two single rollers 11, rotatably journaled to two lateral supports 18. In this embodiment, the single rollers 11 are disposed along a circular-arc plane with a radius of curvature that is ½ the radius of the roll 2. However, according to the disclosure the circular-arc plane or arcuate plane can also have a radius of curvature that is greater than ½ the radius of the roll 2, particularly greater than ⅘ the radius of the roll 2, so that the web of material rests crease-free on the lifting unit 3 when the lifting unit 3 is in the second position II. In other words, the web of material is to be deflected with as large a radius as possible. This reduces any undesirable back-sway of the sagging portion of the web of material due to the intermittent operation. The end portions of the circular-arc plane or arcuate plane should also extend tangentially to the provided direction of travel of the web of material to bring about crease-free deflection of the web of material, particularly crease-free deflection by 90°. It is also advantageous to mount the support 18 of the lifting mechanism 3 off-center from the axis of the roll 2, also to permit crease-free deflection of the web of material.

According to FIG. 2, a braking and/or clamping mechanism 12 is provided to fix the web of material after or during the braking of the web of material, so that the inertia of the web of material is braked when the web is halted. The braking and/or clamping mechanism 12 preferably includes a lower portion and an upper portion.

The braking and/or clamping mechanism 12 depicted in FIG. 2 is designed such that on actuation, a force is exerted in the direction of the roll 2. In this way, when the web of material is halted and the braking and/or clamping mechanism 12 actuated, not only is the inertia of the web of material braked, but the roll 2 is braked as well.

Alternatively, the braking and/or clamping mechanism 12 can be adapted such that on actuation, a force is exerted in the direction of the fixed portion 4 of the support structure 1. In this case, the bottom portion can be attached to the fixed portion 4 of the support structure 1 or can be formed directly by the fixed portion 4 of the support structure 1.

The braking and/or clamping mechanism 12 according to FIG. 2 includes two crossbars, the braking and/or clamping mechanism 12 being designed to press, on actuation, the two crossbars against the web of material. Alternatively, the braking and/or clamping mechanism 12 can include two brake rollers, with the web traveling between them. The brake rollers can include a brake mechanism for braking or clamping the web of material. Optionally, at least one axis of the brake rollers can be provided to be shiftable.

Figure 8B:
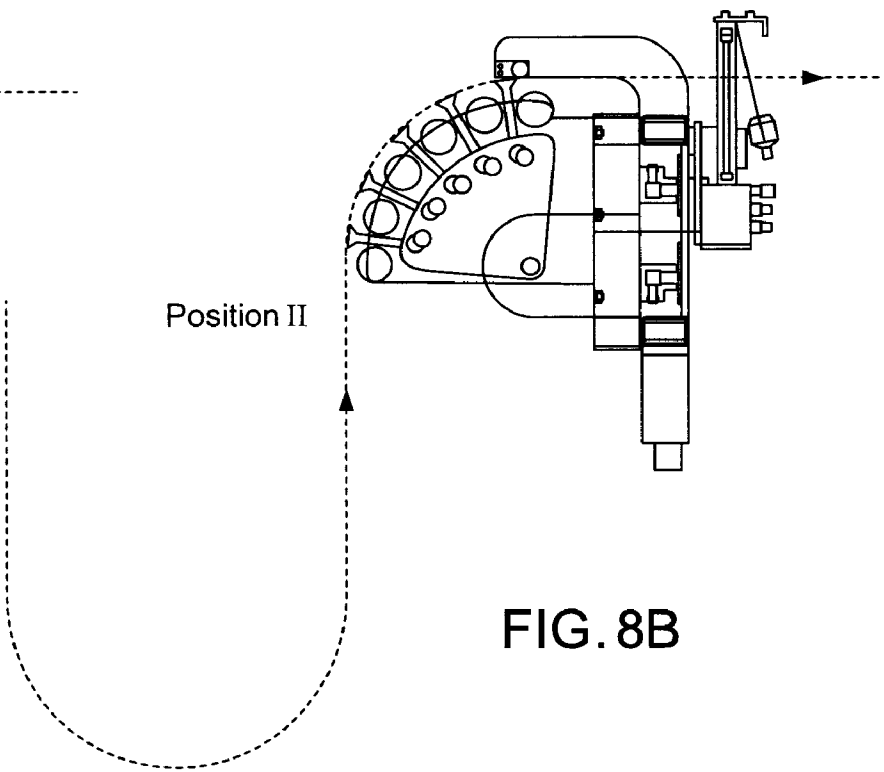
FIGS. 8*a* and 8*b* show a cross section of an apparatus for controlling the lateral offset of webs of material according to a further embodiment of the present disclosure, the lifting mechanism being in the first position I in FIG. 8*a* and in the second position II in FIG. 8*b*.
Figure 8A:
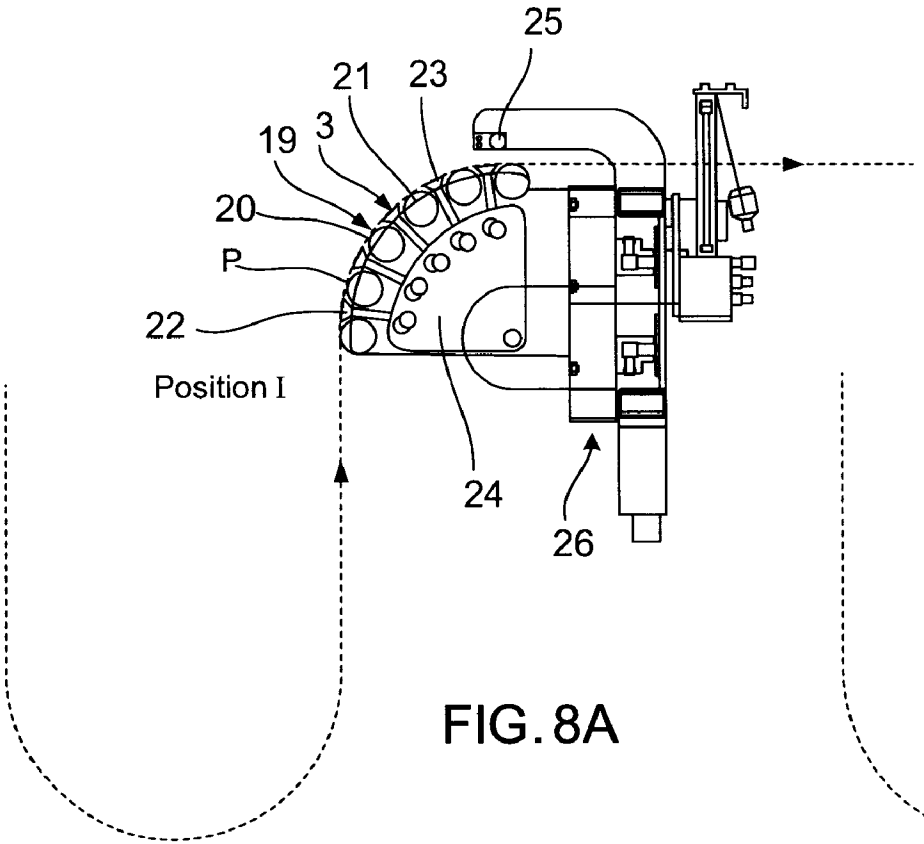

The cross section illustrated in FIG. 8*a* and FIG. 8*b* shows an apparatus for controlling the lateral offset of webs of material, which according to the present disclosure includes a guide mechanism 19 for guiding the web of material during the advancement of the web of material and a lifting mechanism 3 for lifting the web of material off the guide mechanism 19. According to the disclosure, the guide mechanism 19 includes at least two interconnected guide units 20, each including one roller 21, and the lifting mechanism 3 includes at least two lifting units 22. The lifting units 22 are arranged in succession or alternation with the guide units 20.

The rollers 21 of the guide units 20 are arranged in succession with one another such that the plane spanned by the axes of the rollers 21 is a circular-arc plane or an arcuate plane. As can be seen from FIG. 8*a* and FIG. 8*b*, the radius of curvature of the circular-arc plane or arcuate plane turns out to be relatively large for design reasons, owing to the alternating arrangement of the guide units 20 and lifting units 22. The end portions of the circular-arc plane or arcuate plane extend tangentially to the provided direction of travel of the web of material to bring about crease-free deflection of the web of material, particularly crease-free deflection by 90°.

The lifting units 22 are arranged in succession or alternation with the guide units 20 in such fashion as to constitute the same circular-arc plane or arcuate plane as the plane spanned by the axes of the rollers 21 of the guide units 20. This is also usually the case for design reasons, due to the alternating arrangement of the guide units 20 and lifting units 22. The lifting units 22 each consist of an elongate body 23 having a straight or slightly curved surface.

The lifting mechanism 3 can be shifted between a first position I and a second position II. In FIG. 8*a*, the lifting mechanism 3 is in the first position I and in operation is not in contact with the web of material. In FIG. 8*b*, the lifting mechanism 3 is in the second position II and in operation lifts the web of material off the guide mechanism 19. To shift the lifting mechanism 3 between the first position I and the second position II, one or more actuators are provided.

In the embodiment illustrated in FIG. 8*a* and FIG. 8*b*, the lifting units 22 are arranged in succession or alternation with the guide units 20 in the provided direction of travel of the web of material. The elongate bodies 23 of the lifting units 22 are preferably moved between the first position I and the second position II in a restrictive guide, particularly a sliding block guide. For this purpose, the lifting units 22 are connected to one another by two first mountings 24, which are pivotably mounted such that the lifting units 22 are retracted in the first position I. From a comparison of FIG. 8*a* and FIG. 8*b*, it is clear that "retracted" in this case means that the surfaces of the lifting units 22, viewed radially, are located below imaginary points (denoted exemplarily by P). Points P are constituted by the support points of the web of material on the rollers 21 during the advancement of the web of material. The lifting units 22 thus are not in contact with the web of material in the first position I. In the second position II, the lifting units 22 are "extended," i.e., their surfaces, viewed radially, are located above imaginary points P, and they lift the web of material off the guide mechanism 19. The lifting units 22 are preferably slightly curved, so that they lift the web of material with exactly the same radius of curvature as that of the guide mechanism 19. This keeps the web of material from creasing when it is lifted by the lifting mechanism 3.

The guide mechanism 19 is movably mounted on a support or a movable portion of a support structure 26, so that the guide mechanism 19 can be displaced relative to the support or the support structure 26 along the axial direction of the rollers 21 of the guide units 20. The guide mechanism 19 in this case is preferably movably mounted on the support or the movable portion of the support structure 26 via a rail system.

According to one embodiment of the present disclosure, a braking and/or clamping mechanism 25 is provided to fix the web of material after or during the braking of the web of material (see FIG. 8*b*), so that the inertia of the web of material is braked when the web of material is halted. The braking and/or clamping mechanism 25 preferably includes a lower portion and an upper portion. In the embodiment depicted in FIG. 8*a* and FIG. 8*b*, the lower portion of the braking and/or clamping mechanism 25 is formed directly by a lifting unit 22. Very fast braking of the web of material can be obtained with this design.

Figure 9:
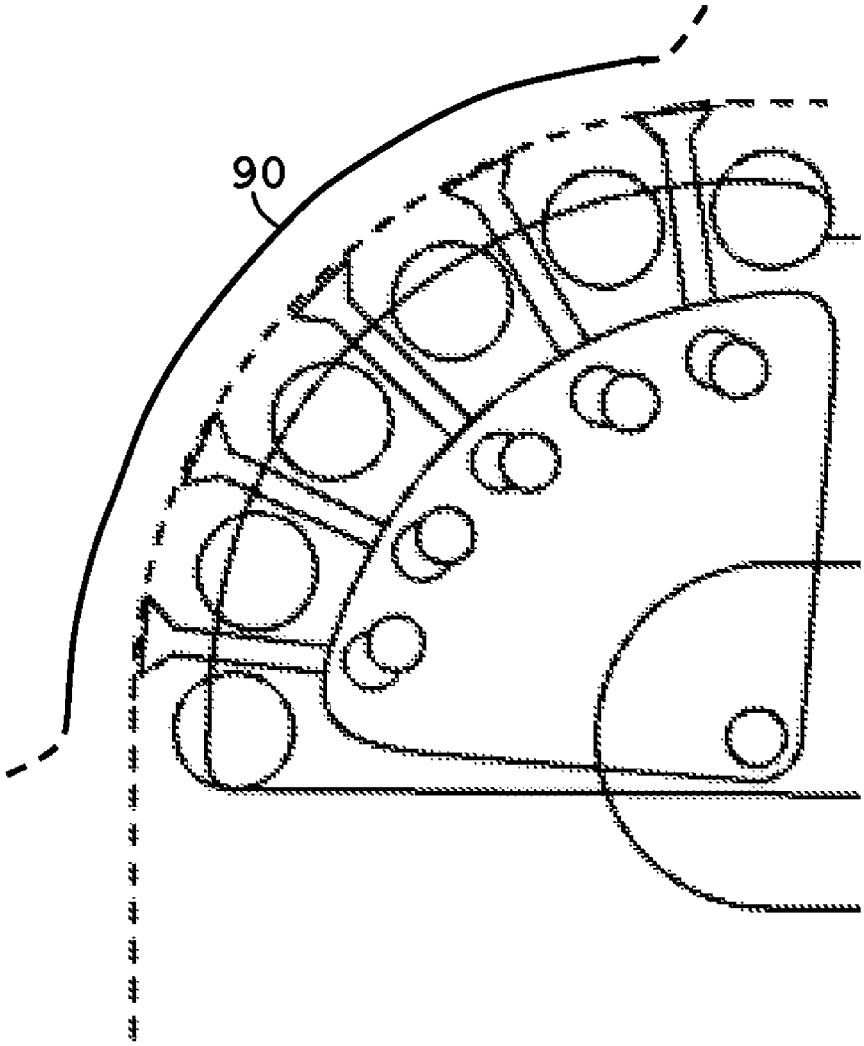
FIG. 9 shows an example arcuate counterplate that can be pressed in the direction of a lifting mechanism.

However, it is expressly noted that the braking and/or clamping mechanism can also be designed such that on actuation, a force is exerted in the direction of the lifting mechanism, particularly the lifting mechanism as a whole. In this case the braking and/or clamping mechanism preferably includes a lower portion formed directly by the lifting mechanism, and an upper portion including an arcuate counterplate that can be pressed in the direction of the lifting mechanism and fits exactly together with the lifting mechanism. When the web of material is halted, the counterplate can first be pressed with little force against the web of material to brake it, and then with greater force to fix the web of material. FIG. 9 shows an example arcuate counterplate, namely, counterplate 90. Very fast braking of the web of material can also be obtained with this design.

It is also expressly noted that the lifting units can naturally also be arranged in succession or alternation with the guide units perpendicularly to the provided direction of travel of the material. In this case, a guide unit includes one or more single rollers arranged in succession with one another such that their axles extend parallel to one another and they are connected to one another by two second mountings, one on each side of each roller. The elongate body of a lifting unit is preferably bent along its longitudinal direction such that it has exactly or approximately the same radius of curvature as the circular-arc plane or arcuate plane spanned by the axes of the rollers of the guide units. This makes it possible for the web of material to be picked up by the lifting mechanism with exactly the same radius of curvature as that of the guide mechanism. This keeps the web of material from creasing when it is lifted by the lifting mechanism. The lifting mechanism is secured by two lateral mountings such that it is movable in translation between the first position and the second position.

The invention claimed is:

1. An apparatus for controlling the lateral offset of webs of material, comprising:

a support structure for supporting a guide roll; and a braking and/or clamping mechanism comprising an upper portion, and a lower portion formed by a lifting mechanism configured to lift a web of material guided by the guide roll off the guide roll, wherein the support structure comprises a fixed portion and at least one laterally movable portion, the support structure connected so that lateral shifting of the movable portion of the support structure laterally shifts the guide roll, and wherein the apparatus further comprises a control unit configured to control the lateral offset of the web of material by shifting the movable portion of the support structure and to return the movable portion and the guide roll to a neutral position while the lifting mechanism has lifted the web of material guided by the guide roll off the guide roll, the movable portion being movable relative to the web of material guided by the guide roll during the return to the neutral position.

2. The apparatus as in claim 1, further comprising first mountings to which the guide roll is journaled, the first mountings being attached to a first laterally movable portion of the support structure such that the guide roll can be moved together with the first mountings.

3. The apparatus as in claim 2, wherein the lifting mechanism is journaled to two mountings attached to a second movable portion of the support structure such that the lifting mechanism can be moved together with the mountings of the lifting mechanism.

4. The apparatus as in claim 3, wherein the first movable portion can be moved together with or independently of the guide roll and the second movable portion can be moved together with or independently of the lifting mechanism.

5. The apparatus as in claim 2, wherein the guide roll is mounted on a shaft that is attached to the first mountings.

6. The apparatus as in claim 5, wherein the shaft of the guide roll is configured as partially or completely hollow.

7. The apparatus as in claim 1, further comprising first mountings to which the guide roll is capable of being journaled, the first mountings being attached to the fixed portion of the support structure, wherein the lifting mechanism is journaled to second mountings attached to the first movable portion of the support structure, such that the lifting mechanism can be moved together with the mountings of the lifting mechanism.

8. The apparatus as in claim 1, wherein the first movable portion of the support structure is mounted on a rail system, to be able to displace the first movable portion in relation to the fixed portion of the support structure, parallel to the axis of the guide roll.

9. The apparatus as in claim 1, wherein the guide roll has a diameter that is greater than ¼ the length of the guide roll.

10. The apparatus as in claim 1, wherein the guide roll has a roll body that comprises a composite material.

11. The apparatus as in claim 1, wherein the lifting mechanism comprises at least two single rollers, which are rotatably journaled to two lateral supports.

12. The apparatus as in claim 11, wherein the single rollers are arranged along a circular-arc plane or along an arcuate plane.

13. The apparatus as in claim 12, wherein the circular-arc plane or the arcuate plane has a radius of curvature that is greater than ¼ the diameter of the guide roll.

14. The apparatus as in claim 12, wherein the lifting mechanism can be shifted between a first position and a second position, it being the case that in the first position, the lifting mechanism is not in contact with the web of material and in the second position, the lifting mechanism holds the web of material off the guide roll.

15. The apparatus as in claim 14, wherein the end portions of the circular-arc plane or the arcuate plane extend tangentially to the direction of travel of the web of material such that crease-free deflection of the web of material is obtained.

16. The apparatus as in claim 1, wherein the support of the lifting mechanism is mounted off-center from the axis of the guide roll.

17. The apparatus as in claim 1, further comprising a braking and/or clamping mechanism configured to fix the web of material.

18. The apparatus as in claim 17, wherein the braking and/or clamping mechanism is adapted to exert, on actuation, a force in the direction of the guide roll.

19. The apparatus as in claim 17, wherein the braking and/or clamping mechanism is adapted to exert, on actuation, a force in the direction of the fixed portion of the support structure.

20. The apparatus as in claim 19, wherein the braking and/or clamping mechanism comprises a lower portion that is attached to the fixed portion of the support structure or is formed directly by the fixed portion of the support structure.

21. The apparatus as in claim 1, wherein the lifting mechanism is mounted such that it is able to move pivotably and/or in translation.

22. The apparatus as in claim 1, further comprising one or more actuators provided to shift the first movable portion and/or the second movable portion of the support structure.

23. The apparatus as in claim 1, wherein the roll is part of a guide mechanism that comprises three rollers arranged along a circular-arc plane or along an arcuate plane.

24. The apparatus as in claim 1, wherein the lifting mechanism comprises three rollers arranged along a circular-arc plane or along an arcuate plane.

25. The apparatus as in claim 1, wherein the lifting mechanism comprises a roller mounted on a shaft.

26. The apparatus as in claim 1, wherein the apparatus comprises:

a guide mechanism that includes the roll; and the lifting mechanism.

27. The apparatus as in claim 26, wherein the lifting mechanism comprises a roller mounted on a shaft, and the guide mechanism comprises three rollers arranged along a circular-arc plane or along an arcuate plane.

28. The apparatus of claim 1, wherein:

the support structure supports a second guide roll; and the lifting mechanism comprises at least two lifting units, the lifting units arranged in alternation with the second guide roll and the guide roll.

29. The apparatus of claim 28, wherein a first of the lifting units is part of the braking and/or clamping mechanism and configured to brake the web of material.

30. The apparatus of claim 1, wherein the upper portion of the braking and/or clamping mechanism comprises an arcuate counterplate.

31. An apparatus for controlling the lateral offset of webs of material, comprising:

a guide mechanism, a braking and/or clamping mechanism comprising a lower portion formed by a lifting mechanism and an upper portion, and a support structure, wherein:

the guide mechanism comprises at least two interconnected guide units, each comprising at least one roller;

the lifting mechanism is configured to lift a web of material guided by the guide mechanism off the rollers of the interconnected guide units;

the support structure comprises a movable portion; and the guide mechanism is movably mounted on the movable portion of the support structure to be displaceable along the axial direction of the rollers of the guide unit, wherein the apparatus further comprises a control unit configured to control the lateral offset of the web of material by shifting the movable portion of the support structure and to return the movable portion and the guide mechanism to a neutral position while the lifting mechanism has lifted the web of material guided by the guide mechanism off the guide mechanism, the movable portion being movable relative to the web of material guided by the guide mechanism during the return to the neutral position.

32. The apparatus as in claim 31, wherein the lifting mechanism comprises at least two lifting units.

33. The apparatus as in claim 32, wherein the lifting units are arranged in succession or alternation with the guide units.

34. The apparatus as in claim 33, wherein the lifting units are arranged in succession or alternation with the guide units in the provided direction of travel of the material.

35. The apparatus as in claim 33, wherein the lifting units are arranged in succession or alternation with the guide units perpendicularly to the provided direction of travel of the material.

36. The apparatus as in claim 35, wherein the single rollers of the guide units are arranged in succession with one another such that their axes extend parallel to one another and such that they are connected to one another via two mountings, one on each side of each the roller.

37. The apparatus as in claim 35, wherein, for each of the lifting units, the respective elongate body of the lifting unit is bent along its longitudinal direction such that it has exactly or approximately the same radius of curvature as the circular-arc plane or the arcuate plane spanned by the axes of the rollers of the guide units.

38. The apparatus as in claim 35, wherein the lifting mechanism is movable in translation between the first and the second position.

39. The apparatus as in claim 33, wherein the rollers of the guide units are arranged in succession with one another such that the plane spanned by the axes of the rollers represents a circular-arc plane or an arcuate plane.

40. The apparatus as in claim 39, wherein the end portions of the circular-arc plane or the arcuate plane extend tangentially to the provided direction of travel of the web of material, such that crease-free deflection of the web of material is produced.

41. The apparatus as in claim 39, wherein the lifting units are arranged in succession or alternation with the guide units such that they constitute the same circular-arc plane or arcuate plane as the plane spanned by the axes of the rollers of the guide units.

42. The apparatus as in claim 31, wherein the lifting mechanism can be shifted between a first position and a second position, it being the case that in the first position the lifting mechanism in operation is not in contact with the web of material, and in the second position the lifting mechanism in operation lifts the web of material off the guide mechanism.

43. The apparatus as in claim 31, wherein the lifting unit comprises one or more elongate bodies having a straight or curved surface.

44. The apparatus as in claim 31, further comprising a braking and/or clamping mechanism configured to fix the web of material.

45. The apparatus as in claim 44, wherein the braking and/or clamping mechanism is adapted to exert, on actuation, a force in the direction of the lifting mechanism.

46. The apparatus as in claim 31, wherein the guide mechanism is movably mounted via a rail system on a support or a movable portion of the support structure, to be able to displace the guide mechanism relative to the support or the support structure along the axial direction of the rollers of the guide units.

47. The apparatus as in claim 31, wherein the at least two interconnected guide units comprise three interconnected guide units, each of the three interconnected guide units comprising at least one roller, the three rollers of the three interconnected guide units being arranged along a circular-arc plane or along an arcuate plane.

48. The apparatus as in claim 47, wherein the lifting mechanism comprises a roller mounted on a shaft.

49. The apparatus as in claim 31, wherein the lifting mechanism comprises three rollers arranged along a circular-arc plane or along an arcuate plane.

50. The apparatus as in claim 31, wherein the lifting mechanism comprises a roller mounted on a shaft.

51. The apparatus of claim 31, wherein:

the guide mechanism comprises at least two rollers; and the lifting mechanism comprises at least two lifting units, the lifting units arranged in alternation with the at least two rollers of the guide mechanism.

52. The apparatus of claim 51, wherein a first of the lifting units is part of the braking and/or clamping mechanism and configured to brake the web of material.

53. The apparatus of claim 31, wherein the upper portion of the braking and/or clamping mechanism comprises an arcuate counterplate.

54. A system for advancing one or more webs of material or for advancing pieces of material, the system comprising:

at least one conveyor belt; and an apparatus for controlling the lateral offset of webs of material as in claim 1.

55. The system as in claim 54, wherein the conveyor belt is arranged before the apparatus for controlling the lateral offset, taken in the direction of travel of the material, and wherein a conveyor belt is arranged after the apparatus for controlling the lateral offset, taken in the direction of travel of the material.

56. The system as in claim 54, wherein an arrangement for receiving a roll of web material is provided, the arrangement comprising a drive unit for unwinding the roll of web material.

57. The system as in claim 54, further comprising a cutting apparatus provided after the apparatus for controlling the lateral offset, taken in the direction of travel of the material, to cut the web of material into pieces of material.

58. The system as in claim 54, further comprising a unit for detecting the position of the web of material.

59. A method comprising:

using an apparatus as in claim 1 to control the lateral offset of webs of material.

60. The method as in claim 59, wherein the apparatus is operated intermittently by a method that comprises:

controlling the lateral offset of the web of material by laterally shifting the roll during the advancement of the web of material, braking the web of material, lifting the web of material off the roll via the lifting mechanism, and returning the roll to a neutral position.

61. The method as in claim 59, wherein the apparatus is operated intermittently by a method that comprises:

controlling the lateral offset of the web of material by laterally shifting the lifting mechanism during the advancement of the web of material, braking the web of material, lowering the lifting mechanism so that the web of material comes into contact with the roll, and returning the lifting mechanism to a neutral position.

62. A system for advancing one or more webs of material or for advancing pieces of material, the system comprising:

at least one conveyor belt; and an apparatus for controlling the lateral offset of webs of material as in claim 31.

63. A method comprising:

using an apparatus as in claim 31 to control the lateral offset of webs of material.

64. A system comprising:

a first conveyor configured to advance a web of material;

a catenary gap disposed after the first conveyor in the direction of travel of the advancing web of material, the catenary gap dimensioned to allow the advancing web of material to form a catenary;

an apparatus for controlling lateral offset of the advancing web of material, the apparatus disposed after the catenary gap in the direction of travel to guide an exit leg of the web of material coming out of the catenary gap, the apparatus comprising a guide mechanism configured to guide the advancing web of material, the guide mechanism comprising at least two rollers having axes arranged in arcuate succession, a lifting mechanism configured to lift the advancing webs of material off the guide mechanism, the lifting mechanism shiftable between a first position in which the lifting mechanism is not in contact with the advancing web of material and a second position in which the lifting mechanism lifts the advancing web of material off the rollers of the guide mechanism, the lifting mechanism comprising at least two lifting units, the lifting units arranged in alternation with the at least two rollers, wherein a first of the lifting units is part of a braking mechanism configured to brake the web of material;

a support structure comprising a movable portion mounting the guide mechanism, the at least two rollers of the guide mechanism thereby movably displaceable along the axes of the rollers, and a control unit configured to control the lateral offset of the web of material by shifting the movable portion of the support structure and to return the movable portion and the guide mechanism to a neutral position while the lifting mechanism has lifted the web of material guided by the guide mechanism off the guide mechanism, the movable portion being movable relative to the web of material guided by the guide mechanism during the return to the neutral position; and a second conveyor configured to advance the web of material, the second conveyor disposed after the apparatus for controlling lateral offset in the direction of travel.

65. The apparatus of claim 64, wherein the braking mechanism comprises:

a lower portion formed by the lifting mechanism; and an upper portion.

66. The apparatus of claim 65, wherein the upper portion of the braking and/or clamping mechanism comprises an arcuate counterplate.

* * * * *

UNITED STATES PATENT AND TRADEMARK OFFICE

CERTIFICATE OF CORRECTION

PATENT NO. : 7,918,372 B2
APPLICATION NO. : 11/686598
DATED : April 5, 2011
INVENTOR(S) : Roland Palatzky and Thomas Grimm It is certified that error appears in the above-identified patent and that said Letters Patent is hereby corrected as shown below:

Col. 14, in claim 36, delete “each the” and insert -- each --.

Signed and Sealed this
Seventeenth Day of May, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,918,372 B2
APPLICATION NO. : 11/686598
DATED : April 5, 2011
INVENTOR(S) : Roland Palatzky and Thomas Grimm It is certified that error appears in the above-identified patent and that said Letters Patent is hereby corrected as shown below:

Column 14, line 19 (Claim 36, line 5) delete “each the” and insert --each--.

This certificate supersedes the Certificate of Correction issued May 17, 2011.

Signed and Sealed this
Twenty-first Day of June, 2011

David J. Kappos

David J. Kappos
*Director of the United States Patent and Trademark Office*